United States Patent [19]

Takano

[11] Patent Number: 4,508,081

[45] Date of Patent: Apr. 2, 1985

[54] FUEL INJECTION PUMP

[75] Inventor: Yoshiya Takano, Katsuta, Japan

[73] Assignee: Hitachi, Ltd., Tokyo, Japan

[21] Appl. No.: 516,911

[22] Filed: Jul. 25, 1983

[30] Foreign Application Priority Data

Jul. 26, 1982 [JP] Japan ..... 57-128931

[51] Int. Cl.[3] ..... F02M 39/00

[52] U.S. Cl. ..... 123/450; 123/502; 417/462

[58] Field of Search ..... 123/450, 502, 501, 458, 123/447; 417/462, 253, 252

[56] References Cited

U.S. PATENT DOCUMENTS

| | | | |
|---|---|---|---|
| 4,282,843 | 8/1981 | Seilly | 417/462 |
| 4,385,610 | 5/1983 | Leblanc | 123/447 |
| 4,428,346 | 1/1984 | Hoshi | 417/462 |
| 4,458,649 | 7/1984 | Takahashi | 123/458 |

FOREIGN PATENT DOCUMENTS

| | | | |
|---|---|---|---|
| 2086080 | 5/1982 | United Kingdom | 123/458 |

*Primary Examiner*—Charles J. Myhre
*Assistant Examiner*—Carl Stuart Miller
*Attorney, Agent, or Firm*—Antonelli, Terry & Wands

[57] ABSTRACT

A fuel injection pump comprises a rotor disposed in a housing and having a pressure chamber therein, a free piston disposed slidably in the pressure chamber dividing the chamber two pump chambers, two solenoid valves for controlling fuel supply, and two preparatory chambers for metering fuel to be fed to the pump chambers. The preparatory chambers and the solenoid valves are arranged in the same plane crossing the axis of the rotor to align with each other. Fuel from a feed pump transfers to the preparatory chamber through the solenoid valve and is metered there. The metered fuel is fed to the pump chamber, pressurized there and delivered to the engine.

5 Claims, 9 Drawing Figures

FUEL INJECTION PUMP

BACKGROUND AND SUMMARY OF THE INVENTION

This invention relates to a fuel injection pump for internal combustion engines, and more particularly to an improvement on a fuel injection pump with preparatory chambers for metering an amount of fuel.

In a fuel injection pump, in order to improve metering precision of an amount of fuel from an electromagnetic valve for metering, and to expand injection timing control range, it is necessary to supply metered fuel from the electromagnetic valve into pump chambers through metering preparatory chambers. Such a fuel injection pump with preparatory chambers is disclosed in prior U.S. patent application Ser. No. 467,302 still pending filed by Yoshiya Takano and Yoshikazu Hoshi on Feb. 17, 1983 (the corresponding European patent application Ser. No. 83101476.6 filed on Feb. 16, 1983). The fuel injection pump comprises a rotor driven by the engine and a housing accomodating the rotor. In the rotor, two pump chambers are formed, and the housing is provided with the preparatory chambers and solenoid valves for metering the fuel to be fed to the chambers. In the rotor and the housing various fuel passages and switching valves are formed, and fuel from a fuel source is delivered to the engine through the solenoid valves, the preparatory chambers, the pump chambers and the various fuel passages and switching valves.

In this fuel injection pump, the various passages and switching valves are relatively complicated and more simple construction is desirable.

An object of the invention, therefore, is to provide a fuel injection pump which is simpler in construction.

Another object of the invention is to provide a fuel injection pump which is compact and stable in construction.

Briefly stated, the present invention resides in that solenoid valves for metering and supplying fuel and metering preparatory chambers are arranged such that fuel from said solenoid valves enters directly into said metering preparatory chamber.

The other features, advantageous effects, etc. of the present invention will be understood by description of an embodiment referring to the drawings.

DESCRIPTION OF THE DISCLOSED EMBODIMENT

Figure 1:
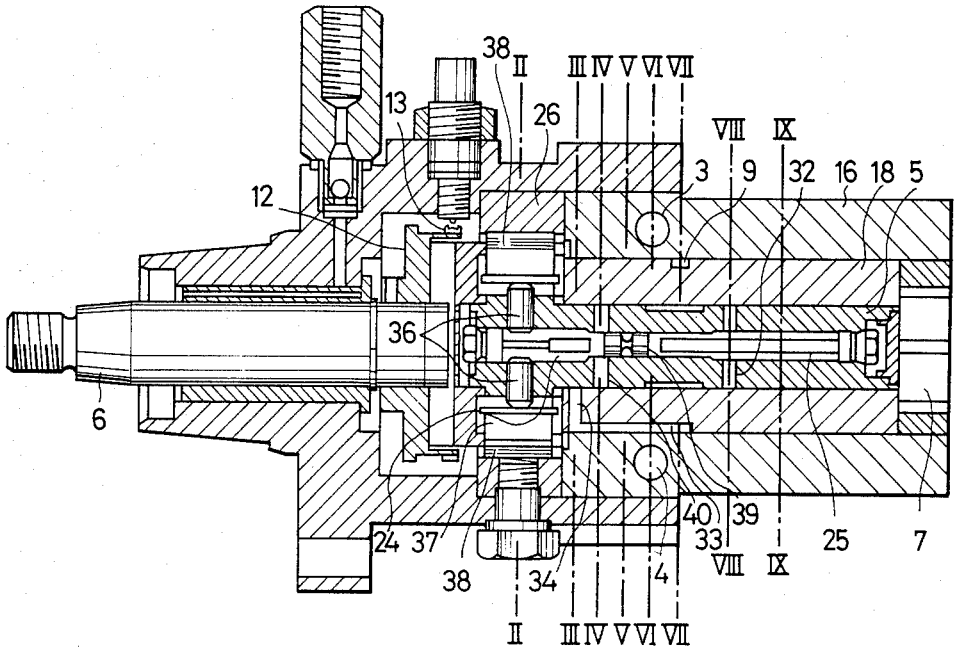
FIG. 1 is a sectional view of an embodiment of a fuel injuection pump according to the present invention.
Figure 6:
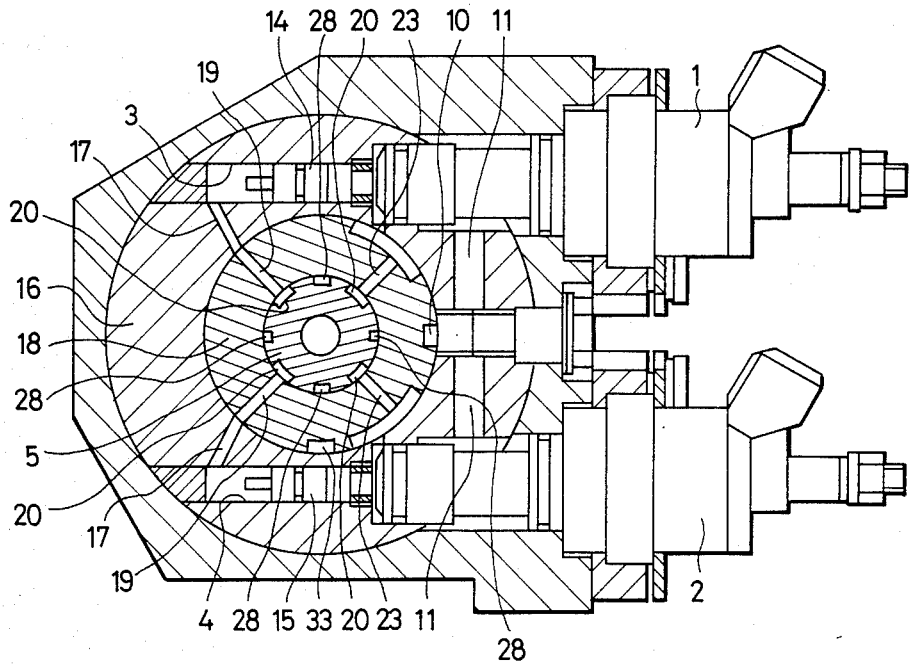

Referring now to the drawings, in FIG. 1 showing a vertical sectional view of a fuel injection pump for a four cylinder internal combustion engine, the fuel injection pump is provided with a shaft 6, driven by the engine and connected to a rotor 5. The rotor 5 is rotatably inserted in a sleeve 18 which is fitted to a base member 16. The sleeve 18 and the base member 16 constitute a housing. The rotor 5 has an axial bore formed along an axis and plugs at the both ends thereby to form a pressure chamber. A free piston 39 is slidably inserted in the pressure chamber and divides it into two pump chambers 24, 25. In each of the chambers 24, 25, a stopper is provided for restricting movement of the free piston 39 within a predetermined range. At one end of the rotor 5, a feed pump 7 is provided for feeding pressurized fuel. The other end of the rotor 5 is connected to the shaft 6 through a coupling means. The base member 16 has a pair of preparatory chambers 3, 4 which are disclosed best in FIG. 6. In FIG. 6, the preparatory chambers 3, 4 for measuring fuel to be fed to the pump chambers are formed in a sectional plane crossing the axis of the rotor 5 at an angle of 90° so as to extend in a perpendicular direction to a radial direction and parallel to each other. In each of the chambers 3, 4, a free piston 14, 15 is slidably disposed thereby to divide the chamber into two parts. The preparatory chambers 3, 4 communicate with the pump chambers 24, 25 and the feed pump 7 through various passages and valves. Metering solenoid valves 1, 2 for measuring an amount of fuel to be injected into the preparatory chambers 3, 4 are mounted on the housing so that the axes align with the preparatory chambers 3, 4 and the fuel from the solenoid valves 1, 2 enter the chambers 3, 4 directly. The various valves and passages formed in the rotor 5, the sleeve 18 and the base member 16 are described later.

Figure 2:
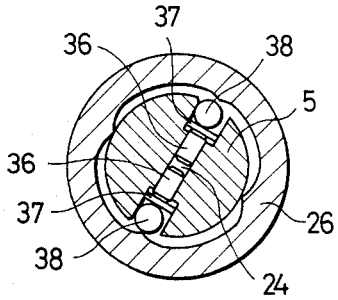
FIG. 2, FIG. 3, FIG. 4, FIG. 5, FIG. 6, FIG. 7, FIG. 8 and FIG. 9 are sectional views taken along a line II—II, a line III—III, a line IV—IV, a line V—V, a line VI—VI, a line VII—VII, a line IIX—IIX and a line IX—IX of FIG. 1, respectively.

On the end portion of the rotor 5 opposite the feed pump 7, as shown in FIG. 2, an expansible chamber is disposed which comprises a compression cam 26 secured to the housing 16, rollers 38 inserted in recesses formed in the rotor 5, shoes 37, and plungers 36. The cam 26 has four projections corresponding to the number of the engine cylinders which move the rollers, shoes and plungers inward as the rotor 5 rotates.

The shaft 6 has a timing gear 12 having pulse generators on the outer portions. A sensor 13 mounted on the housing 16 so as to face the pulse generator detects pulses from the timing gears 12 and transmits them to the solenoid valves 1, 2.

In the rotor 5, the sleeve 18 and base member 16, various passages are formed, and compound switching valves are formed between the sleeve 18 and the rotor 5. The feed pump 7, the solenoid valves 1, 2, the preparatory chambers 3, 4, the pressure chamber, etc. are communicable with each other through the various passages and the compound switching valves. The various passages and the compound switching valves are as follows: (The solenoid valve 1 and the preparatory chamber 3 are in a metering fuel supply line for controlling the amount of injected fuel, and the solenoid valve 2 and the preparatory chamber 4 are in a metering fuel supply line for controlling the timing of fuel timing control fuel.)

8*s*: Fuel induction passage 8 formed axially in the sleeve 18 from the feed pump position to VII—VII section in FIG. 7 (appears in FIGS. 7, 8, 9).

Figure 7:
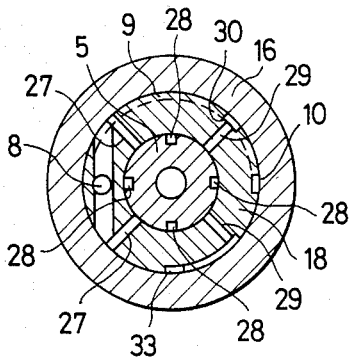

9*s*: Peripheral groove 9 formed in the periphery of the sleeve 18 in VII—VII section and communicating with 8*s* (FIG. 1, FIG. 7).

10*s*: Induction groove 10 formed axially in the periphery of the sleeve 18 from VII—VII section to VI—VI section and communicating with 9*s* (FIGS. 6, 7).

11*h*: Induction bore 11 formed in the base member 16 communicating with 10*s* (FIG. 6).

17*h*: Discharge ports 17 formed in the base member 16 and communicating with the preparatory chambers 3 and 4, respectively (FIG. 6).

19s: Discharge ports 19 formed in the sleeve 18 and communicating with 17s (FIG. 6).

Figure 5:
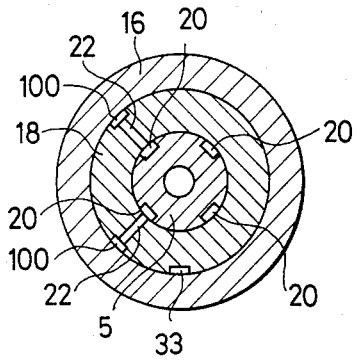

20r: Discharge grooves 20 of four (4) formed in the periphery of the rotor 5 equiangularly, and being communicable with 19s and 23s (later described). 20r extends axially from the VI—VI section to V—V section in FIG. 5, (FIGS. 6, 5).

22s: Discharge ports 22 formed in the V—V section of the sleeve 18 and being communicable with 20r, (FIG. 5).

23s: Supply passages 23 formed in the sleeve 18 and being communicable with 20r and 28r (later described), (FIG. 6). 23s is communicable with 11h through the solenoid valve 1, 2 disposed in the induction passage 11.

27s: Supply ports 27 formed in the sleeve 18, communicating with 8s and 9s and being communicable with grooves 28, (FIG. 7).

28r: Supply grooves 28 formed axially and equiangularly in the sleeve, separated from each other by 90°, extending from VII—VII section to VI—VI section, and being communicable with 19s, 23s, 27s and 29s, (FIGS. 6, 7).

29s: Supply ports 29 formed in the sleeve 18 and connected to 30s and 33s, respectively, (FIG. 7).

Figure 8:
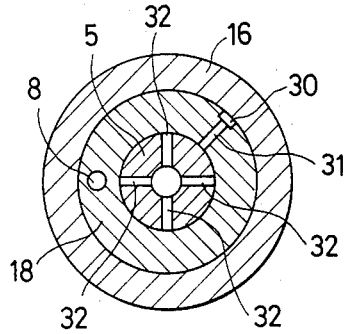
Figure 9:
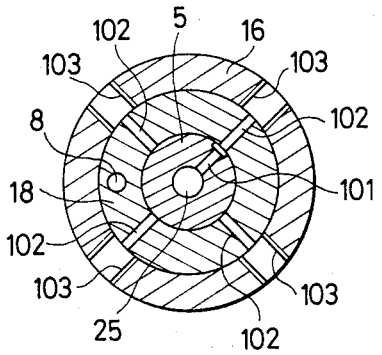

30s: Supply groove 30 formed in the sleeve periphery, extending axially from VII—VII section to VIII—VIII section (FIGS. 7, 8).

31s: Supply hole 31 formed in the sleeve 18 and being able to communicate 32r with 30s, (FIG. 8).

32r: Supply holes 32 (four) formed separated from each other by 90 in the rotor 5, communicating with the pump chamber 25, (FIG. 1, FIG. 8).

33s: Supply groove 33 formed in the sleeve 18 to extend from VII—VII section to III—III section, (FIGS. 1, and 3 to 7).

Figure 3:
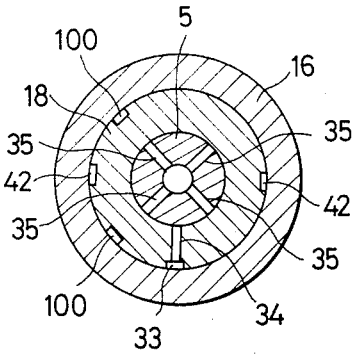

34s: Supply holes 34 formed in the sleeve, connected to 33s and being communicable with 35r, (FIGS. 1, 3).

35r: Supply holes 35 (four) formed equiangularly, communicating with the pump chamber 24, (FIG. 3).

Figure 4:
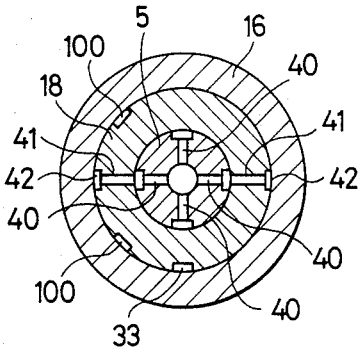

40r: Spill-ports 40 (four) formed in the rotor 5, communicating with the pump chamber 24, (FIGS. 1, 4).

41s: Spill-passages 41 formed in the sleeve 18, communicating with 40r, (FIG. 4).

42s: Communication passages 42 formed in the sleeve periphery, (FIGS. 3, 4).

100s: Discharge groove 100 formed axially in the sleeve 18, (FIGS. 3 to 5).

101r: Delivery hole 101 formed in the rotor 5, communicating with the pump chamber 25, (FIG. 7).

102s: Delivery holes (four 102, formed in the sleeve and communicable with the delivery hole 102 (FIG. 7).

103h: Delivery ports 103 formed in the base member 16 for communicating 103h with the engine through pipes (not shown) (FIG. 7).

With the above construction, fuel from the above-mentioned feed pump 7 is supplied to each of the metering solenoid valve 1 for controlling an amount of fuel to be injected into the engine and the metering solenoid valve 2 for controlling injection timing through passages of 8s-9s-10s-11h. In the state shown in FIG. 1, electric pulses are given to the valves 1, 2 to open them, an amount of fuel corresponding to the electric pulses for opening is supplied directly into the preparatory metering chambers 3, 4 at timing corresponding to the electric pulse. The timing at which the valve opening pulses are applied to the valves 1, 2 is determined by detecting signals from the timing gear 12 with the sensor 13. In the preparatory valves 3 and 4 receiving fuel, the free pistons 14 and 15 are moved left in FIG. 6, and the fuel contained in the chambers on the left of the free pistons 3, 4 is discharged into a lower pressure portion (not shown) of the fuel injection pump through the passages 17h→19s→20r→22s→100s, whereby the metering operation of measured fuel to the preparatory chambers 3, 4 on the right side of the free pistons 14, 15 is completed.

In addition to this metering operation, the fuel already contained in the pump chambers 24 and 25 is pressurized by the operation of the compression cam 26. In this stage, the metering and temporary accomodation of fuel by the solenoid valves 1, 2 and the preparatory chambers 3, 4 are effected while the compression of fuel in the pump chambers 24, 25 is carried out for injection thereof into the engine.

In order to supply the metered fuel contained in the preparatory chambers 3, 4 into the pump chambers 24, 25, the rotor 5 is rotated by 45°. At this time, the rotor 5 is shifted angularly by 45° relatively to the sleeve 18 from the position of FIGS. 1 to 9. In this relative position between the rotor 5 and the sleeve 18, pressure raised by the feed pump 7 as a pressure source reaches the preparatory chambers 3, 4 on the left side of the free pistons 14, 15 through the passages 8s—27s—28r—19s—17r, thereby to move the free piston to the right side. By this operation, the metered fuel contained in the preparatory chamber 3 on the right side of the free piston 14 is fed to the pump chamber 25 through the passages 23s—28r—29s—30s—31s—32r, (FIGS. 6, 7, 8). Further, the metered fuel contained in the preparatory chamber 4 on the right side is fed to the pump chamber 24 through the passages 23s—28r—29s—33s—34s—35r (FIGS. 6, 7, 3). As the fuel is fed to the pump chamber 4, the plungers 36, the rollers shoes 37 and the roller 38 are moved outward so that the chamber 24 is expanded by the volume corresponding to the amount of the fuel fed to the chamber 4, whereby the operation of supply of the metered fuel contained in the preparatory chamber 4 is carried out.

After completion of the above-mentioned fuel supply to the pump chambers 24, 25, further, the rotor 5 is rotated by 45° so that the relative position between the rotor 5 and sleeve 18 is returned to the position shown in FIGS. 1 to 9. In the FIGS. 1 to 9, the metering state and the compression period state are shown.

In the same manner as above, every time the rotor 5 rotates by 45°, the above metering and compression operation and the fuel supplying operation are carried out alternately.

The compression is carried out in the following manner as shown in FIGS. 1 and 2, when fuel is fed to the pump chamber 24. Namely, as the rotor 5 rotates, the rollers 38 contact projections of the cam 26, whereby the rollers 38, the roller shoes 37 and the plungers 36 are pressed inwardly so that the fuel in the pump chamber 24 is highly pressurized. The time the fuel is pressurized is determined by the contact position between the cam 26 and the roller 38. The contact position, that is, fuel injection timing can be controlled by an amount of the fuel fed to the pump chamber 24. The amount of the fuel can be controlled by an amount of fuel sent from the solenoid valve 2, that is, valve opening pulse width applied to the solenoid valve 2.

As above-mentioned, when the fuel in the pump chamber 24 is made high in pressure, the free piston 39 is moved to the right side, and the interior of the pump chamber 25 is pressurized in turn. Therefore, the fuel in the pump chamber 25 is delivered into the combustion chamber of the engine through the passages 101*r*—102*s*—103*h*— a delivery valve (not shown)— a pressure pipe (not shown)— an injection valve (not shown).

As the fuel is injected on, the left end of the free piston 39 is moved in the pump chamber 24 thereby to start to open the spill-port 40 which has been closed by the free piston 39.

Therefore, the fuel in the pump chamber 24 begins to be discharged through the passages 40*r*—41*s*—42*s*. Consequently, pressure in the pump chamber 24, in turn, pressure in the pump chamber 25 drops thereby to bring the injection of fuel into the engine to an end, and the pump chamber 24 starts to shrink by contact between the rollers 38 and the projections of the cam 26, whereby the fuel discharge from the pump chamber 24 is ended. Further, in the pump chamber 25, all the amount of fuel fed thereto from the solenoid valve 1 through the preparatory chamber 3 is fed to the engine. Therefore, the amount of fuel to be injected can be controlled precisely by opening the solenoid valve 1 according to the opening pulse width applied thereto.

As apparent from the above-mentioned, in the present invention, fuel passages from the solenoid valves 1, 2 to the preparatory chambers 3, 4 do not rely on passages of the compound switching valve, and the preparatory chambers 3, 4 communicate directly with the immediately downstream portions of the solenoid valves so that the fuel injection pump can be made simpler as compared with the other construction of of fuel injection pump with preparatory chambers. Further, the solenoid valves 1, 2 can be arranged coaxially of the preparatory chamber so that the fuel injection pump can be made more compact and stable.

What is claimed is:

1. A fuel injection pump for an internal combustion engine comprising:

a rotor disposed in a housing and being rotatable according to rotation of the engine;

a pressure chamber formed in said rotor;

a first free piston slidably inserted in said pressure chamber, and dividing said pressure chamber into a first pump chamber and a second pump chamber, said first pump chamber being communicable with the interior of the engine through delivery passages and said second pump chamber being communicable with discharge passages for discharging the fuel therein;

means for pressurizing fuel in said pressure chamber according to the rotation of said rotor thereby delivering fuel to the engine;

a pair of preparatory chambers for metering and supplying fuel into said pressure chamber, each of said preparatory chambers being provided with a second free piston which divides its preparatory chamber into first and second preparatory chambers; and a pair of electromagnetic valves for controlling feeding of fuel to respective ones said first preparatory chambers, wherein said electromagnetic valves are arranged to communicate directly with respective ones of said first preparatory chambers for supplying fuel thereto without intervening valves.

2. The fuel injection pump of claim 1, wherein said pair of electromagnetic valves and said pair of preparatory chambers are arranged such that their axes are disposed in substantially the same plane crossing the axis of said rotor.

3. The fuel injection pump of claim 2, wherein said plane crosses the axis of said rotor at a right angle.

4. The fuel injection pump of claim 3, wherein said electromagnetic valves are aligned with respective ones of said pair of preparatory chambers.

5. A fuel injection pump for internal combustion engines comprising:

a rotor disposed in a housing and being rotatable according to rotation of the engine;

a pressure chamber formed in said rotor;

a first free piston slidably inserted in said pressure chamber, and dividing said pressure chamber into a first pump chamber and a second pump chamber, said first pump chamber being communicable with the interior of the engine through delivery passages, and said second pump chamber being communicable with discharge passages for discharging the fuel therein;

means for pressurizing fuel in said pressure chamber according to the rotation of said rotor thereby delivering the fuel to the engine;

a pair of preparatory chambers for metering amounts of fuel to be supplied to said pressure chamber, each of said preparatory chambers provided with a second free piston which divides its preparatory chamber into first and second preparatory chambers;

a pair of electromagnetic valves for controlling feeding of fuel to respective ones of said first preparatory chambers, said electromagnetic valves being arranged to communicate directly with said first preparatory chambers so that supply of fuel from said electromagnetic valves to said first preparatory chambers is controlled only by said electromagnetic valves;

first fuel passage means for leading fuel from a feed pump to said first preparatory chambers by way of said electromagnetic valves which control the feeding of fuel to said first preparatory chambers;

second fuel passage means for leading fuel from said first preparatory chambers to said pressure chamber;

third fuel passage means for leading fuel from said feed pump to said second preparatory chambers;

fourth fuel passage means for discharging fuel out of said second preparatory chambers; and fuel passage switching valve means provided on said second, third and fourth fuel passage means for switching the same fuel passage means according to rotation of said rotor.

* * * * *